United States Patent [19]

Inoue et al.

[11] Patent Number: 4,722,884

[45] Date of Patent: Feb. 2, 1988

[54] SILVER HALIDE PHOTOGRAPHIC LIGHT-SENSITIVE MATERIALS AND METHOD FOR FORMATION OF NEGATIVE IMAGES OF ULTRA-HIGH CONTRAST USING SAID MATERIAL

[75] Inventors: Nobuaki Inoue; Senzo Sasaoka; Kenichi Kuwabara; Kimitaka Kameoka, all of Kanagawa, Japan

[73] Assignee: Fuji Photo Film Co., Ltd., Kanagawa, Japan

[21] Appl. No.: 757,973

[22] Filed: Jul. 23, 1985

[30] Foreign Application Priority Data

Jul. 23, 1984 [JP] Japan ..... 59-152498

[51] Int. Cl.[4] ..... G03C 5/24; G03C 1/02

[52] U.S. Cl. ..... 430/446; 430/447; 430/448; 430/264; 430/949; 430/599; 430/600; 430/605; 430/569

[58] Field of Search ..... 430/264, 605, 567, 265, 430/267, 446, 447, 448, 569, 564, 599, 600, 949

[56] References Cited

U.S. PATENT DOCUMENTS

| | | | |
|---|---|---|---|
| 4,210,450 | 7/1980 | Corben | 430/567 |
| 4,241,164 | 12/1980 | Mifune et al. | 430/264 |
| 4,288,535 | 9/1981 | Kanisawa et al. | 430/264 |
| 4,323,643 | 4/1982 | Mifune et al. | 430/567 |
| 4,433,048 | 2/1984 | Solberg et al. | 430/567 |

*Primary Examiner*—Won H. Louie

*Attorney, Agent, or Firm*—Sughrue, Mion, Zinn, Macpeak & Seas

[57] ABSTRACT

A negative silver halide photographic light-sensitive material is provided, having a silver halide emulsion layer, which layer comprises silver haloiodide grains prepared in the presence of an iridium salt in an amount of $1\times10^{-8}$ to $1\times10^{-5}$ mole per one mole of silver, wherein the silver iodide content in the surface part of said grain is larger than the average silver iodide content in said grain, and additionally containing in said emulsion layer or in some other hydrophilic colloid layer, a compound of formula (I):

$$R_1\text{—NHNH—CHO} \qquad \text{(I)}$$

wherein $R_1$ represents an aliphatic group or an aromatic group. Said photographic light-sensitive material is, after being exposed imagewise, developed with a developer containing 0.15 mole/l or more sulfite ion and having a pH value of 9.5–12.3, to form negative images having ultra-high contrast. The present photographic light-sensitive material has good photographic characteristics of sensitivity and gamma value, and the preservation stability thereof is good.

8 Claims, No Drawings

SILVER HALIDE PHOTOGRAPHIC LIGHT-SENSITIVE MATERIALS AND METHOD FOR FORMATION OF NEGATIVE IMAGES OF ULTRA-HIGH CONTRAST USING SAID MATERIAL

FIELD OF THE INVENTION

The present invention relates to silver halide photographic light-sensitive materials which are useful in the field of graphic arts and to a method for formation of negative images of ultra-high contrast using said materials.

BACKGROUND OF THE INVENTION

In the field of graphic arts, an image formation system capable of giving the photographic characteristic of ultra-high contrast (especially having a gamma value of 10 or more) is required, and must be sufficient to attain a good reproduction of a half-tone image of continuous tone as well as a good reproduction of a line image.

A specific developer called a lith developer has heretofore been used for said purpose. The lith developer contains only hydroquinones as a developing agent, and uses a sulfite as preservative in the form of an adduct of a sulfite with formaldehyde in order not to deteriorate the infectious developability thereof. The concentration of the free sulfite ion in said developer is kept extremely low (generally, 0.1 mole/l or less). Thus, the lith developer extremely easily suffered aerial oxidization and cannot last more than three days, which is a serious defect.

Methods for obtaining the photographic characteristic of high contrast by the use of a stable developer and a hydrazine derivative are disclosed in U.S. Pat. Nos. 4,224,401, 4,168,977, 4,166,742, 4,311,781, 4,272,606, 4,211,857 and 4,243,739. According to said methods, the photographic characteristic of ultra-high contrast and high sensitivity may be obtained, and moreover, addition of a sulfite of high concentration to a developer is possible. Accordingly, the stability of the developer against aerial oxidation is markedly improved, as compared to the lith-developer.

These conventional methods using a hydrazine derivative, however, have some problems in that the sensitivity and the gradation of light-sensitive materials are lowered when said materials are preserved for a lapse of time. In addition, if some conventional sensitization means are applied to the light-sensitive materials in order to improve the sensitivity thereof (for example, the grain size of silver halide grains contained therein are made larger, or the light-sensitive materials are sensitized with a novel metal sensitizer), a problem occurs known as "black spots" in this technical field. The "black spots" are those appearing in non-image parts (for example, among half-tone dots), which markedly occur when the pH value of the developer to be used becomes higher after being preserved for a lapse of time and thus fatigued. The occurrence of such "black spots" extremely lowers the quality of photographs.

SUMMARY OF THE INVENTION

The object of the present invention is therefore to provide silver halide photographic light-sensitive materials which can attain sufficient photographic characteristics of ultra-high contrast by the use of a stable developer and which are good in preservation stability for a lapse of time, having high sensitivity and less black spots, and a method for formation of negative images of ultra-high contrast using said materials.

The object of the present invention is attained by a negative silver halide photographic light-sensitive material having a silver halide emulsion layer, which layer comprises silver haloiodide grains prepared in the presence of an iridium salt in an amount of $1\times10^{-8}$ to $1\times10^{-5}$ mole per one mole of silver, wherein the silver iodide content in the surface part of said grain is larger than the average silver iodide content in said grain, and additionally containing in said emulsion layer or in some other hydrophilic colloid layer, a compound of a formula (I):

$$R_1\text{—NHNH—CHO} \qquad \text{(I)}$$

wherein $R_1$ represents an aliphatic group or an aromatic group and a method for formation of negative images of ultra-high contrast, by treating said silver halide photographic light-sensitive material with a developer containing 0.15 mole/l or more sulfite ion and having a pH value of 9.5–12.3.

In particular, silver haloiodide grains contained in the silver halide emulsion layer of the present invention are characterized in that these are prepared in the presence of an iridium salt in an amount of $1\times10^{-8}$ to $1\times10^{-5}$ mole per one mole of silver and that the silver iodide content in the surface part of said grain is larger than the average silver iodide content in said grain.

DETAILED DESCRIPTION OF THE INVENTION

In the present invention, it is preferred that an iridium salt of the above-mentioned amount is added prior to the physical ripening step in the manufacture of the silver halide emulsion, especially during the formation of silver halide grains.

Iridium salts which may be used in the present invention include water-soluble iridium salts or iridium complex salts, for example, iridium trichloride, iridium tetrachloride, potassium hexachloro-iridate(III), potassium hexachloro-iridate(IV), ammonium hexachloro-iridate(III), etc.

The "surface part" of the silver haloiodide grains means herein the depth of 100 A to 200 A from the surface of said grain. It is particularly preferred in the present invention that the silver halide content in said surface part of the silver haloiodide grains contained in the silver halide emulsion layer is larger than the average silver iodide content in said grains by 50% or more.

The silver iodide content in the surface part of silver haloiodide grains may be measured by XPS method using an X-ray photoelectronic spectrophotometer apparatus (XPS); and the average silver iodide content in said grains may also be measured by XPS method using said XPS analogously to the former, after a sample has been annealed at 300° C. for 3 hours to unify the distribution of silver iodide therein.

In order to form a silver haloiodide emulsion having such intra-grain distribution so as to satisfy the above defined silver iodide content ratio, conventional means may be utilized, including, for example, a conversion method as described in U.S. Pat. Nos. 2,592,250 and 4,075,020 and Japanese Patent Application (OPI) No. 127549/80 (the term "OPI" as used herein means a "published unexamined Japanese patent application") and a method for preparation of core/shell emulsions as described in British Pat. No. 1,027,146. More precisely, a conversion method involves preparing silver bromide by simultaneously adding a silver nitrate aqueous solution and a potassium bromide aqueous solution to a gelatin solution which is kept at a constant temperature, and keeping the pAg value of the resulting mixture solution at a constant value, and then the surface of said silver bromide grains is converted by adding a potassium iodide aqueous solution thereto. A modification method thereof can also be used, where a potassium iodide aqueous solution are added simultaneously with a potassium bromide aqueous solution immediately before the finish of the addition of the silver nitrate aqueous solution (but the potassium iodide is not added later). A specific method for formation of a silver iodide shell on the surface of a silver bromide core grain involves adding fine silver iodide grains to a reaction container either immediately prior to the finish of the addition of a silver nitrate aqueous solution to a gelatin solution or after said addition, and then subjecting the resulting emulsion to Ostwald ripening. In these methods, the grain size may be varied by varying the period of time for addition of the silver nitrate aqueous solution and the potassium bromide aqueous solution and the temperature of the reaction container.

Silver haloiodide grains which may be used in the present invention are any of silver iodobromide, silver iodochlorobromide and silver chloroiodide grains, and the silver iodide content thereof is 0.01–10 mole%, preferably 0.1–5 mole%, on the average. In particular, the preferred halogen composition is silver iodobromide.

The silver haloiodide grains to be used in the present invention are preferably fine grains, and the average grain size thereof is preferably 0.7$\mu$ or less, more preferably 0.5$\mu$ or less. The grain size distribution of said silver haloiodide grains is not fundamentally limited, but the emulsion containing said grains is preferably a monodisperse-emulsion. Said "monodisperse-emulsion" means that at least 95% of the total silver haloiodide grains constituting the emulsion, said percentage being relative to the weight or to the number of said grains, have a grain size falling within the range of the average grain size thereof $\pm$40%.

The silver haloiodide grains to be used in the photographic emulsion may have a regular crystalline form such as a cubic form or an octahedral form, or alternatively may have an irregular crystalline form such as a spherical form or a tabler form. A composite-crystalline form comprising a mixture of said regular and irregular crystalline forms can also be used.

The silver haloiodide grains may have a uniform inner phase and outer surface layer phase or may have different phases therebetween. A mixture of two or more different silver halide emulsions, which have been prepared differently and individually, may be used in the present invention.

In the silver haloiodide emulsion to be used in the present invention, a cadmium salt, a sulfite, a lead salt, a thallium salt, a rhodium salt or a complex salt thereof, etc. may be present, during the formation of silver halide grains or during the step of physical ripening thereof.

The hydrazine derivatives to be used in the present invention will now be explained in detail.

The hydrazine derivatives of the present invention are those represented by a general formula (I):

$$R_1\text{—NHNH—CHO} \qquad \text{(I)}$$

wherein $R_1$ is an aliphatic group or an aromatic group.

In the above formula (I), aliphatic groups represented by $R_1$ are preferably those having 1–30 carbon atoms, and in particular are preferred to be straight chain, branched chain or cyclic alkyl groups having 1–20 carbon atoms. Said branched chain alkyl groups may include saturated heterocyclic groups containing one or more hetero atoms therein. Said alkyl groups may optionally be substituted by an aryl group, an alkoxy group, a sulfoxy group, a sulfonamide group, a carbonamide group, etc.

Examples of said aliphatic groups are t-butyl, n-octyl, t-octyl, cyclohexyl, pyrrolidyl, imidazolyl, tetrahydrofuryl and moropholino groups.

Aromatic groups represented by $R_1$ in said formula (I) are monocyclic or bicyclic aryl groups or unsaturated heterocyclic groups. Said unsaturated heterocyclic groups may optionally form hetero-aryl groups, as condensed with a monocyclic or bicyclic aryl group.

Examples of said aromatic groups are those containing a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, etc.; and benzene ring-containing groups are preferred among them.

$R_1$ is especially preferably an aryl group. Said aryl group and other aromatic groups of $R_1$ may optionally be further substituted. Typical substituents of said aryl or aromatic groups include a straight chain, branched chain or cyclic alkyl group (preferably having 1–20 carbon atoms), an aralkyl group (preferably monocyclic or bicyclic group where the alkyl part contains 1–3 carbon atoms), an alkoxy group (preferably having 1–20 carbon atoms), a substituted amino group (preferably substituted by (an) alkyl group(s) having 1–20 carbon atoms), an acylamino group (preferably having 2–30 carbon atoms), a sulfonamide group (preferably having 1–30 carbon atoms), an ureido group (preferably having 1–30 carbon atoms), etc. $R_1$ in said general formula (I) may contain a ballast group which is generally used in a non-diffusible state photographic additive such as a coupler. Said ballast groups are those having 8 or more carbon atoms, which are relatively inactive to photographic characteristics, and for example, may be selected from alkyl groups, alkoxy groups, phenyl groups, alkylphenyl groups, phenoxy groups, alkylphenoxy groups, etc.

$R_1$ in said general formula (I) may further contain an adsorbent group capable of reinforcing the adsorbability of said hydrazine derivative to the surface of silver halide particles. Examples of said adsorbent groups include thiourea groups, heterocyclic thioamide groups, mercapto-heterocyclic groups, triazole groups, etc., as described in U.S. Pat. No. 4,385,108.

Synthesis of said compounds is described in Japanese Patent Application (OPI) Nos. 20921/78, 20992/78, 66732/78, 20318/78, etc.

In the present invention, when the compound of the general formula (I) is to be incorporated in a photographic light-sensitive material, said compound is preferably incorporated in a silver halide emulsion layer of said material, but is not limited thereto. Said hydrazine derivative compound may also freely be incorporated in any other non-sensitive hydrophilic colloid layers (for example, protective layer, intermediate layer, filter layer, antihalation layer, etc.). In practice, when the compound to be added is water soluble, this may be added to the hydrophilic colloidal solution in the form of an aqueous solution; or on the contrary, when the compound to be added is sparingly water soluble, said compound may be added thereto in the form of a solution dissolved in an organic solvent which is compatible with water, such as an alcohol, an ester, a ketone, etc. If the hydrazine derivative compound is to be added to a silver halide emulsion layer, the addition may be carried out in any desired step from the beginning of chemical ripening to before coating, and it is preferred to add said compound during the period from after the finish of the chemical ripening to before the coating. In particular, it is most preferred to add said compound to a coating solution just ready for coating.

The amount of the hydrazine derivative compound of the formula (I) contained in the photographic light-sensitive material of the present invention is preferably determined to be an optimum content, the optimum content depending upon the grain size of the silver halide emulsion in said photographic light-sensitive material, the halogen composition in said emulsion, the method of chemical sensitization for said material and the degree thereof and the relation between the layer containing said hydrazine derivative compound and the silver halide emulsion layer, as well as upon the kind of anti-fogging compound contained in said photographic material. The test method for said selection is well known by those skilled in the art. In general, the amount of said compound of the formula (I) is preferably within the range of $10^{-6}$ mole to $1\times10^{-1}$ mole, especially $10^{-5}$ mole to $4\times10^{-2}$ mole, per one mole of a silver halide.

Examples of compounds of the formula (I) are given below, which, however, do not whatsoever restrict the scope of the formula (I).

I-1

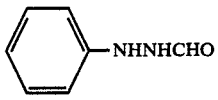

I-2

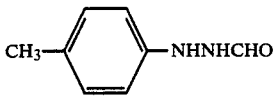

I-3

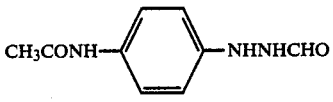

I-4

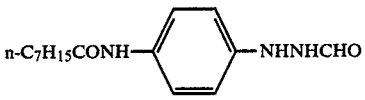

I-5

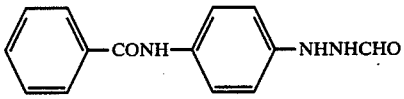

I-6

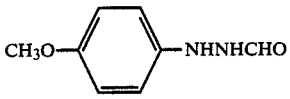

I-7

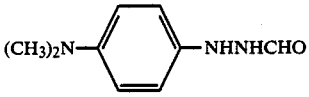

I-8

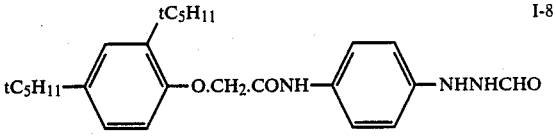

I-9

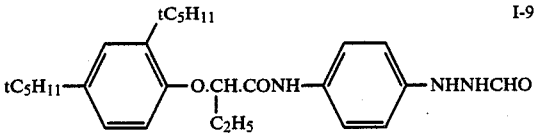

I-10

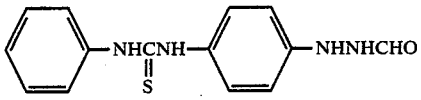

I-11

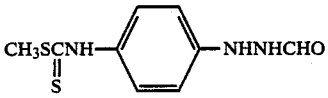

I-12

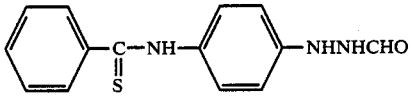

I-13

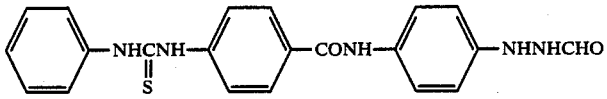

I-14

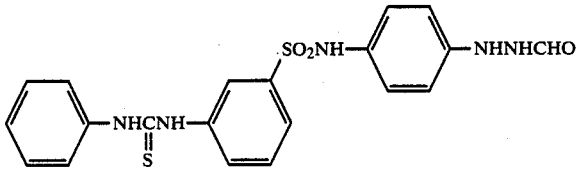

-continued
I-15
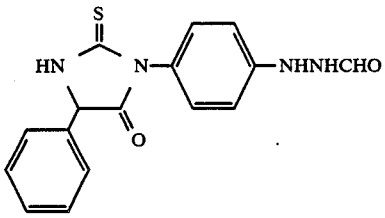
I-16
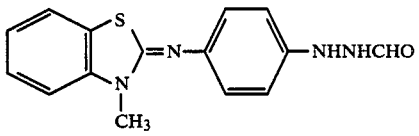
I-17
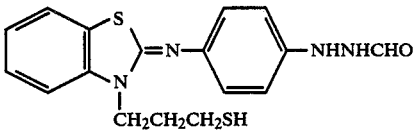
I-18
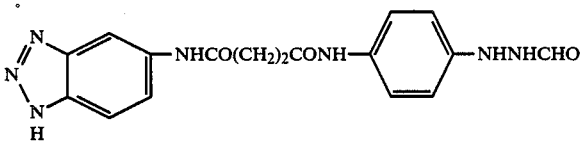
I-19
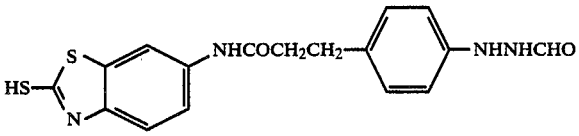
I-20
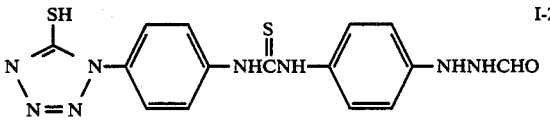
I-21
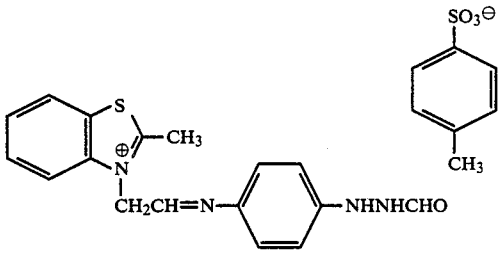
I-22
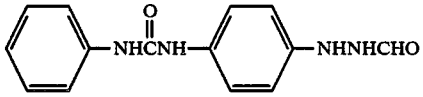
I-23
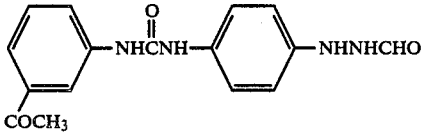
I-24
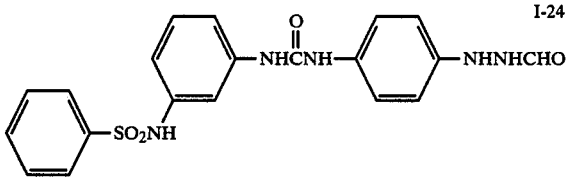
I-25
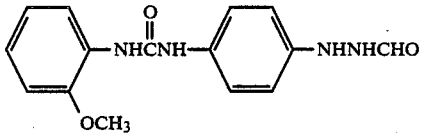
I-26
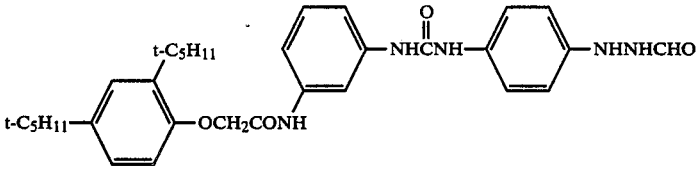
I-27
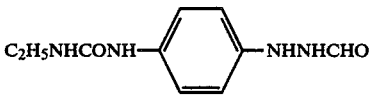
I-28
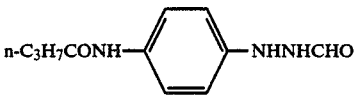
The photographic emulsion to be used in the present invention may optionally be spectrally sensitized, and various kinds of sensitizing dyes which are known in the technical field of photographic light-sensitive materials, for example, cyanine dyes or merocyanine dyes, may be used therefor. Preferred sensitizing dyes are those described in Japanese Patent Application (OPI) No. 52050/80, and cyanine dyes of the following formula (II) are especially preferred among them.

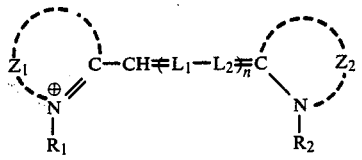

(II)

wherein $Z_1$ and $Z_2$ each represents atoms necessary for formation of a thiazole nucleus, a thiazoline nucleus, a benzothiazole nucleus, a naphthothiazole nucleus, an oxazole nucleus, a benzoxazole nucleus, an oxazoline nucleus, a naphthoxazole nucleus, an imidazole nucleus, a benzimidazole nucleus, an imidazoline nucleus, a selenazole nucleus, a selenazoline nucleus, a benzoselenazole nucleus or a naphthoselenazole nucleus; $R_1$ and $R_2$ each represents an alkyl group or a substituted alkyl group, with the proviso that at least one of $R_1$ and $R_2$ has a sulfo group or a carboxyl group; $L_1$ and $L_2$ each represents a substituted or unsubstituted methine group; and n is an integer of 0 to 2.

The nucleus formed by said $Z_1$ or $Z_2$ may optionally be substituted by substituent(s) which are known in the technical field of cyanine dyes. Examples of said substituents are alkyl groups, alkoxy groups, alkoxycarbonyl groups, aryl groups, aralkyl groups, halogen atoms, etc.

$R_1$ and $R_2$ may be same or different from each other. Alkyl groups of said $R_1$ and $R_2$ are preferably those having 1 to 8 carbon atoms, for example, methyl, ethyl, propyl, butyl, pentyl or heptyl groups. Substituents of said substituted alkyl groups of $R_1$ and $R_2$ are, for example, a carboxyl group, a sulfo group, a cyano group, a halogen atom (such as a fluorine, chlorine or bromine atom), a hydroxyl group, an alkoxycarbonyl group (having 8 or less carbon atoms, such as methoxycarbonyl, ethoxycarbonyl or benzyloxycarbonyl group), an alkoxy group (having 7 or less carbon atoms, such as methoxy, ethoxy propoxy, butoxy or benzyloxy group), an aryloxy group (such as a phenoxy or p-tolyloxy group), an acyloxy group (having 3 or less carbon atoms, such as an acetyloxy or propionyloxy group), an acyl group (having 8 or less carbon atoms, such as an acetyl, propionyl, benzoyl or mesyl group), a carbamoyl group (such as a carbamoyl, N,N-dimethylcarbamoyl, morpholinocarbamoyl or piperidinocarbamoyl group), a sulfamoyl group (such as a sulfamoyl, N,N-dimethylsulfamoyl or morpholinosulfonyl group), an aryl group (such as a phenyl, p-hydroxyphenyl, p-carboxyphenyl, p-sulfophenyl or α-naphthyl group), etc. Said substituted alkyl group preferably has 6 or less carbon atoms.

Examples of substituted methine groups of $L_1$ and $L_2$ are a lower alkyl group (such as a methyl, ethyl or propyl group), a phenyl group, a benzyl group, etc.

Examples of cyanine dyes of said formula (II), which are preferred to be used in the present invention are given below, which, however, do not whatsoever restrict the scope of the formula (II).

(1)

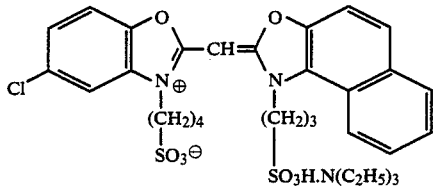

(2)

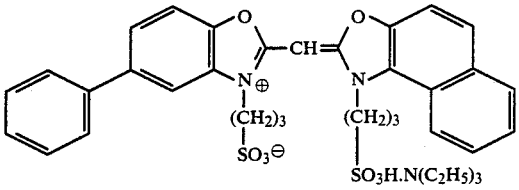

(3)

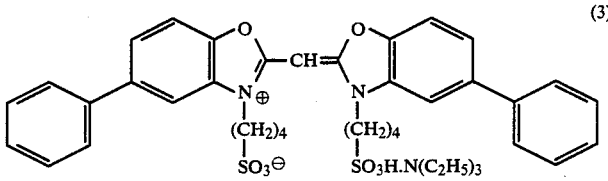

(4)

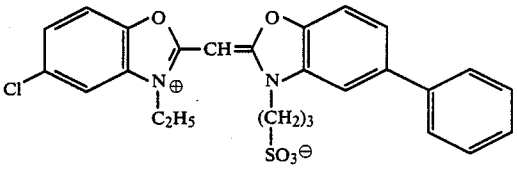

(5)

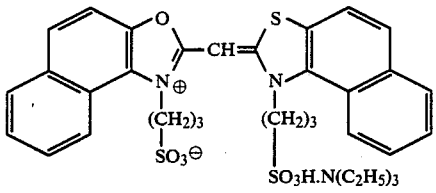

(6)

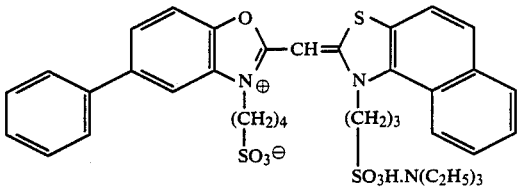

(7)

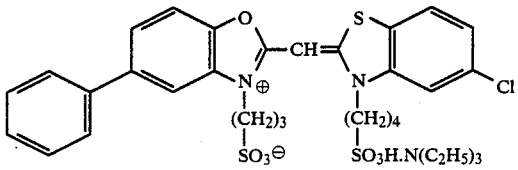

-continued
(8)
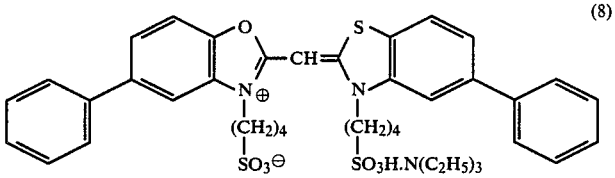
(9)
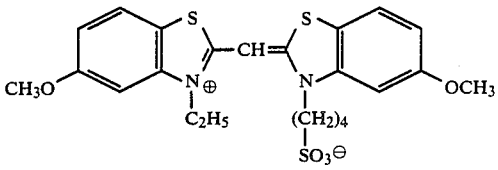
(10)
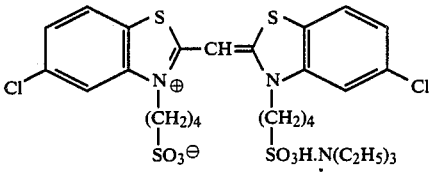
(11)
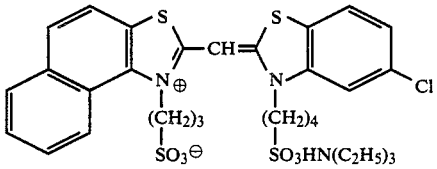
(12)
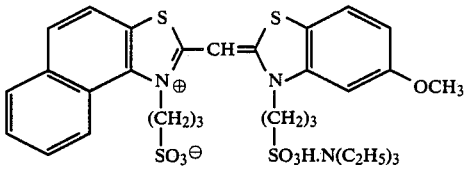
(13)
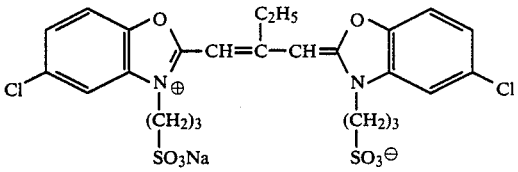
(14)
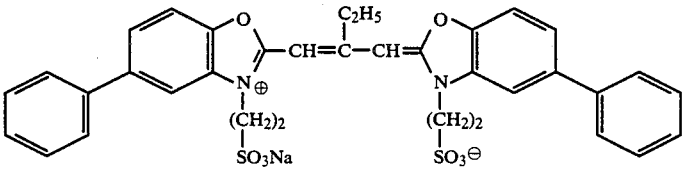
(15)
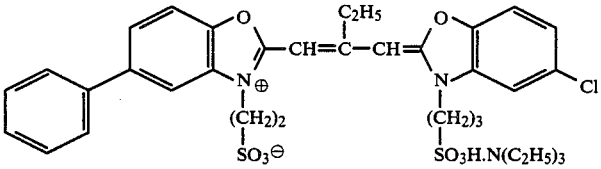
(16)
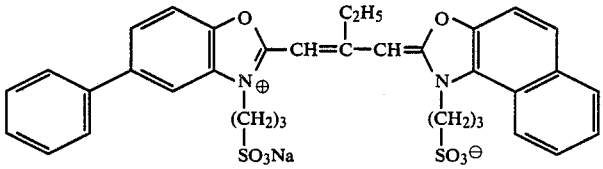
(17)
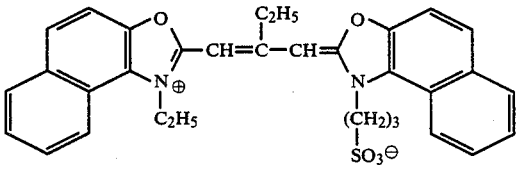
(18)
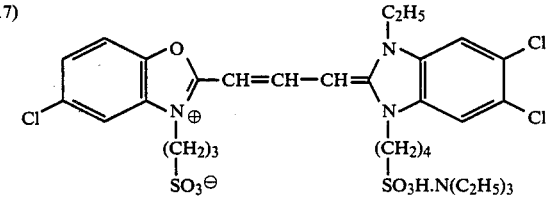
(19)
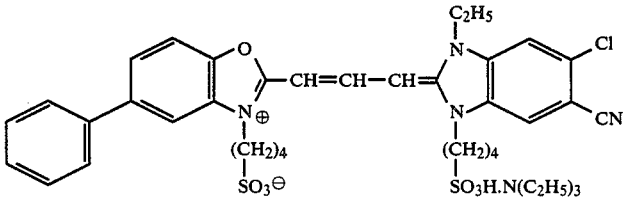

-continued (20)

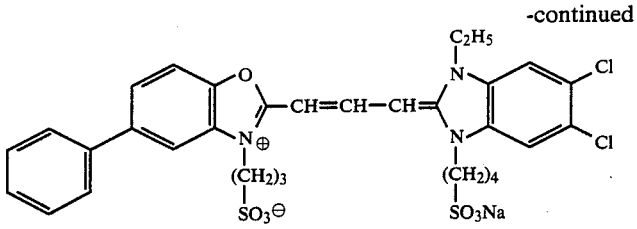

(21)

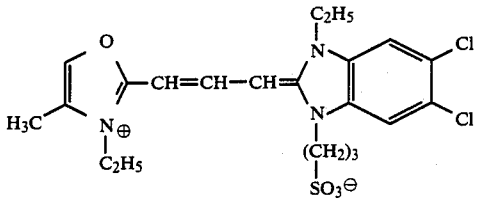

(22)

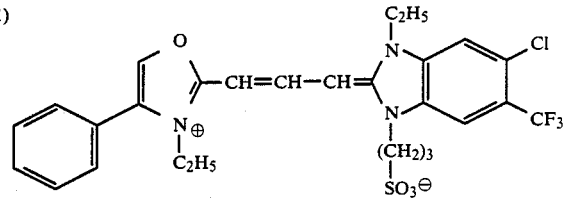

(23)

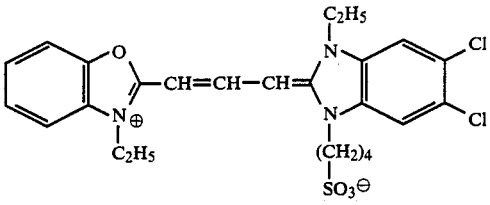

(24)

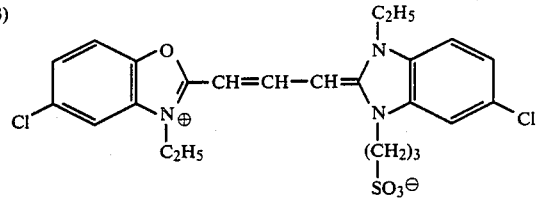

(25)

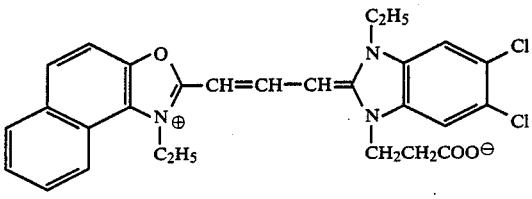

(26)

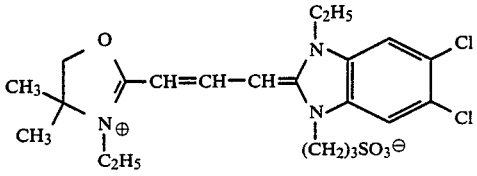

(27)

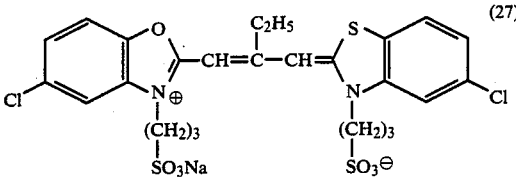

(28)

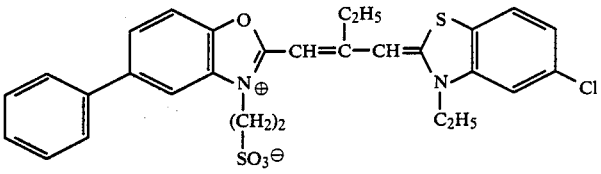

(29)

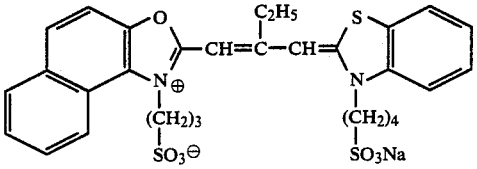

(30)

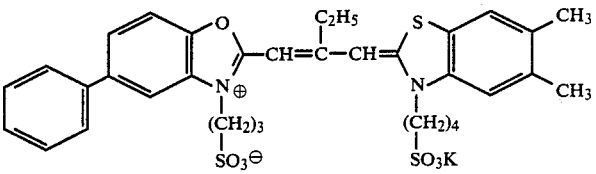

(31)

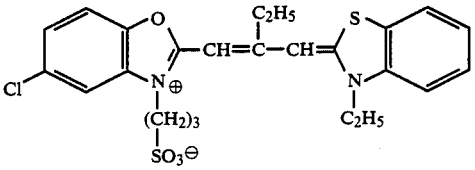

(32)

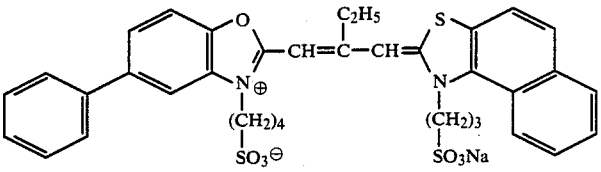

Other various compounds may further be incorporated in the photographic emulsion to be used in the present invention, in order to prevent the occurrence of fog or to stabilize the photographic characteristics during the manufacture or preservation of photographic light-sensitive materials or during the photographic treatment thereof. For instance, various compounds which are known as an anti-fogging agent or a stabilizer may be added to the present photographic emulsion, including azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially, 1-phenyl-5-mercaptotetrazole), etc.; mercaptopyrimidines; mercaptotriazines; thioketo compounds such as oxazolinethione; azaindenes such as triazaindenes, tetraazaindenes (especially, 4-hydroxy-substituted-(1,3,3a,7)tetraazaindenes), pentaazaindenes, etc.; benzenethiosulfonic acid, benzenesulfinic acid, benzenesulfonic acid amide, etc.

Among them, benzotriazoles (e.g. 5-methylbenzotriazole) and nitroindazoles (e.g. 5-nitroindazole) are especially preferred. These compounds may be added to a treating solution.

The photographic light-sensitive materials of the present invention may contain an inorganic or organic hardening agent in the photographic emulsion layer or in the other hydrophilic colloid layer. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen-compounds (e.g., 2,4-dichloro-6-hydroxy-s-triazine, etc.) and mucohalogenic acids (e.g., mucochloric acid, mucophenoxychloric acid, etc.) and so on can be used singly or in the form of a combined mixture of said compounds.

The light-sensitive materials of the present invention may further contain various kinds of surfactants, in the photographic emulsion layer or in the other hydrophilic colloid layer, for various purposes such as a coating aid, an antistatic, slide property improvement, accelerating emulsification and dispersion, prevention of adhesion and photographic characteristic improvement (for example, development acceleration, increasing high contrast, sensitization).

For instance, said surfactants include non-ionic surfactants such as saponins (steroid-type), alkyleneoxide derivatives (e.g. polyethylene glycol, polyethylene glycol/polypropylene glycol condensation product, polyethylene glycol alkylethers or polyethylene glycol-alkylarylethers, polyethylene glycol esters, polyethylene glycol sorbitan esters, polyalkylene glycol alkylamines or amides, polyethylene oxide adducts of silicone, etc.), glycidol derivatives (e.g., alkenyl succinic acid polyglycerides, alkylphenol polyglycerides, etc.), fatty acid esters of polyhydric alcohols and alkylesters of saccharides; anionic surfactants containing an acidic group such as carboxyl, sulfo, phospho, sulfuric ester or phosphoric ester group, for example, alkylcarboxylic acid salts, alkylsulfonic acid salts, alkylbenzenesulfonic acid salts, alkylnaphthalenesulfonic acid salts, alkyl sulfates, alkyl phosphates, N-acyl-N-alkyltaurines, sulfo-succinates, sulfo-alkylpolyoxyethylene-alkylphenylethers, polyoxyethylene alkyl phosphates, etc.; amphoteric surfactants such as amino acids, aminoalkylsulfonic acids, aminoalkyl sulfates or phosphates, alkylbetaines, amine oxides, etc.; and cationic surfactants such as alkylamine salts, aliphatic or aromatic quaternary ammonium salts, heterocyclic quaternary ammonium salts (e.g. pyridinium or imidazolium salts), aliphatic or heterocyclic ring-containing phosphonium or sulfonium salts, etc.

Especially preferred surfactants in the present invention are polyalkylene oxides having a molecular weight of 600 or more, which are described in Japanese Patent Publication No. 9412/83.

The photographic light-sensitive materials of the present invention may further contain a dispersion of a water-insoluble or sparingly water-soluble synthetic polymer in the photographic emulsion layer or in the other hydrophilic colloid layer, for the purpose of improvement of the dimensional stability of the photographic light-sensitive materials. For example, polymers or copolymers of alkyl (meth)acrylate, alkoxyalkyl (meth)acrylates, glycidyl (meth)acrylates, (meth)acrylamides, vinyl esters (e.g. vinyl acetate), acrylonitriles, olefins, styrenes, etc.; as well as those formed by the combination of said monomers and acrylic acids, methacrylic acids, $\alpha,\beta$-unsaturated dicarboxylic acid, hydroxyalkyl (meth)acrylates, sulfoalkyl (meth)acrylates, styrene-sulfonic acids, etc. may be used therefor.

In order to obtain a photographic characteristic of ultra-high contrast and high sensitivity, using the silver halide photographic light-sensitive material of the present invention, it is not necessary to use any conventional-infectious developer or any other high alkaline developer having a pH value of near 13, as described in U.S. Pat. No. 2,419,975, and a stable developer may be used for the photographic light-sensitive materials of the present invention.

Accordingly, the silver halide photographic light-sensitive materials of the present invention may yield negative images of sufficiently ultra-high contrast by the use of a developer containing a sulfite preservative in an amount of 0.15 mol/l or more and having a pH value of 9.5 to 12.3, especially 10.5 to 12.3.

Developing agents to be used in the present invention are not specifically limited, and for example, dihydroxybenzenes (e.g., hydroquinone), 3-pyrazolidones (e.g., 1-phenyl-3-pyrazolidone, 4,4-dimethyl-1-phenyl-3-pyrazolidone), aminophenols (e.g., N-methyl-p-aminophenol), etc. may be used singly or in the form of a combined mixture thereof.

The silver halide photographic light-sensitive materials of the present invention are preferably treated with a developer containing dihydroxybenzenes as a main developing agent and 3-pyrazolidones or aminophenols as an auxiliary developing agent. In said developer, the content of said dihydroxybenzenes is preferably 0.05 to 0.5 mole/l, and that of said 3-pyrazolidones or aminophenols is preferably 0.06 mole/l or less, and such combination is preferred.

The developer of the present invention may further contain a pH buffer such as an alkali metal sulfite, carbonate, borate or phosphate; and a development restrainer or an anti-fogging agent such as a bromide, an iodide or an organic anti-fogging agent (especially preferably nitroindazoles and benzotriazoles). In addition, the present developer may further contain, if necessary, a hard water softener, a solubilizer, a toning agent, a development accelerator, a surfactant (especially preferably the above-described polyalkylene oxides), a deforming agent, a hardening agent, a silver-stain inhibitor (such as 2-mercaptobenzimidazole-sulfonic acids), etc.

Examples of said additives are known, as described, for example, in *Research Disclosure,* No. 176 (RD-17643).

As a fixing solution, any conventional ones may be used. As a fixing agent may be used a thiosulfate and a thiocyanate, and in addition, any other organic sulfur compounds which are known to be effective as a fixing agent may also be used. Said fixing solution may optionally contain a water-soluble aluminium salt as a hardening agent.

The temperature upon development treatment is selected in general from the range of 18°–50° C., but said temperature may optionally be lower than 18° C. or may optionally be higher than 50° C.

An automatic development apparatus is preferably utilized for the photographic treatment of the present materials. The photographic light-sensitive material of the present invention may attain a sufficient photographic characteristic of negative gradation of ultra-high contrast and high sensitivity, when treated in an automatic development apparatus for a short period of treatment time of 90–120 seconds, which is the total time to be spent from the introduction of the photographic material to be developed into the apparatus to the taking said material out of the apparatus.

According to the present invention, excellent photographic characteristics are attainable, having an extremely high sensitivity and an ultra-high contrast with less black spots, which are especially effective for reproduction of half-tone images and line images, due to the combined use of the above described silver haloiodide emulsion comprising silver haloiodide grains, which contain the above-determined amount of an iridium salt, the silver iodide content of said grain in the surface part thereof being larger than the average silver iodide content of said grain, and the compound of the above-defined formula (I), and by the use of a stable developer. In addition, the silver halide photographic light-sensitive materials of the present invention are further advantageous in that the photographic characteristics thereof hardly lower or deteriorate during the preservation thereof. In particular, even when the materials are preserved under the severe condition of a high temperature and a higher humidity, the sensitivity and the gamma value thereof hardly deteriorate.

The present invention will now be explained in greater detail by reference to the following Examples which are not meant to be limiting.

Unless otherwise specified all ratios, percents, etc. are by weight.

EXAMPLE 1

Preparation of Emulsion (A)

A silver nitrate aqueous solution, a potassium iodide aqueous solution and a potassium bromide aqueous solution were simultaneously added to a gelatin aqueous solution kept at 50° C., over a period of 60 minutes, while the pAg value of the mixed solution was kept at 7.5, to prepare a monodisperse silver iodobromide emulsion (having an average grain size of 0.26μ and an average silver iodide content of 2 mole%).

The obtained emulsion was rinsed with water in a conventional manner to remove soluble salts therefrom, and sodium thiosulfate was added thereto for chemical sensitization. The emulsion thus obtained was called Emulsion (A).

Preparation of Emulsion (B)

In the same manner as in the preparation of the above Emulsion (A), with the exception that the mixing of the silver nitrate aqueous solution, the potassium iodide aqueous solution and the potassium bromide solution was carried out in the presence of potassium hexachloroiridate(III) in an amount of $4\times10^{-7}$ mole per one mole of silver, a mono-disperse silver iodobromide emulsion (having an average grain size of 0.26μ and an average silver iodide content of 2 mole%) was prepared.

The obtained emulsion was rinsed with water and then subjected to chemical sensitization, analogously to Emulsion (A), and was called Emulsion (B).

Preparation of Emulsion (C)

Potassium iodide was added to the above obtained Emulsion (B), after being chemically sensitized, to convert the surface of the particles in the emulsion, whereby a silver iodobromide emulsion having a ratio (the average silver iodide content/the silver iodide content in the surface part of the particle) of $\frac{1}{3}$ was obtained. This was called Emulsion (C).

Preparation of Emulsion (D)

In the same manner as in the preparation of the above Emulsion (A), with the exception that the mixing of the silver nitrate aqueous solution, the potassium iodide aqueous solution and the potassium bromide solution was carried out in the presence of potassium hexachloroiridate(III) was used in an amount of $2\times10^{-7}$ mole per one mole of silver, a monodisperse silver iodobromide emulsion (having an average grain size of 0.26μ and an average silver iodide content of 2 mole%) was obtained.

The obtained emulsion was rinsed with water and then chemically sensitized analogously to Emulsion (A). Thereafter potassium iodide was added thereto to convert the surface of the particles in the emulsion, whereby a silver iodobromide emulsion having a ratio (the average silver iodide content/the silver iodide content in the surface part of the grain) of $\frac{1}{3}$ was obtained. This was called Emulsion (D).

Preparation of Emulsion (E)

In the same manner as in the preparation of the above Emulsion (A), with the exception that the ratio of potassium iodide to potassium bromide was so changed that the silver iodide content in the obtained emulsion was 1 mole%, a monodisperse silver iodobromide emulsion (having an average grain size of 0.26μ and an average silver iodide content of 1 mole%) was prepared.

This was rinsed with water and then chemically sensitized, analogously to Emulsion (A), to obtain an emulsion called Emulsion (E).

Preparation of Emulsion (F)

In the same manner as in the preparation of the above Emulsion (E), with the exception that the mixing of the silver nitrate aqueous solution, the potassium iodide aqueous solution and the potassium bromide solution was carried out in the presence of potassium hexachloro-iridate(III) in an amount of $4\times10^{-7}$ mole per one mole of silver, a monodisperse silver bromoiodide emulsion (having an average grain size of 0.26μ and an average silver iodide content of 1 mol%) was prepared.

The obtained emulsion was rinsed with water and then subjected to chemically sensitization, analogously to Emulsion (E), and was called Emulsion (F).

Preparation of Emulsion (G)

Potassium iodide was added to the above obtained Emulsion (F), after being chemically sensitized, to convert the surface of the grains in the emulsion, whereby a silver iodobromide emulsion having a ratio (the average silver iodide content/the silver iodide content in the surface part of the grain) of 1/5 was obtained. This was called Emulsion (G).

Preparation of Emulsion (H)

Potassium iodide was added to the above obtained Emulsion (F), after being chemically sensitized, to convert the surface of the grains in the emulsion, whereby a silver iodobromide emulsion having a ratio (the average silver iodide content/the silver iodide content in the surface part of the grain) of 1/10 was obtained. This was called Emulsion (H).

Preparation of Emulsion (I)

In the same manner as in the preparation of the above Emulsion (A), with the exception that potassium chloro-aurate was further added during the chemically sensitization of the emulsion to elevate the sensitivity thereof, an emulsion called Emulsion (I) was prepared.

Preparation of Emulsion (J)

In the same manner as in the preparation of the above Emulsion (A), with the exception that the period of time and the temperature upon mixing of the silver nitrate aqueous solution and the halide aqueous solutions were so changed that the average grain size of the formed silver halide grains became 0.32μ, an emulsion called Emulsion (J) was prepared.

To each of the above prepared Emulsions (A) through (J) were added 4-hydroxy-6-methyl-1,3,3a,7-tetraazaindene, polyethyl acrylate dispersion, polyethylene glycol (molecular weight: 1000) and 1,3-vinylsulfonyl-2-propanol, and then, the above-described compound No. (I-9) of the formula (I) of the present invention was added thereto in an amount of $4.5\times10^{-3}$ mole per one mole of silver. The emulsion was thereafter coated on a cellulose triacetate film, the coated silver amount being 4 g/m$^2$. Each of the films thus formed was exposed to light through a optical wedge for sensitometry, and then developed with a developer having the following composition at 38° C. for 30 seconds, and thereafter stopped, fixed, rinsed and dried.

Composition of Developer:

| | |
|---|---|
| Hydroquinone | 40.0 g |
| 4,4-dimethyl-1-phenyl-3-pyrazolidone | 0.4 g |
| Sodium hydroxide | 13.0 g |
| Anhydrous potassium sulfite | 90.0 g |
| Potassium tertiary phosphate | 74.0 g |
| Disodium ethylenediamine-tetraacetate | 1.0 g |
| Potassium bromide | 6.0 g |
| 5-methylbenzotriazole | 0.6 g |
| 1-diethylamino-2,3-dihydroxypropane | 17.0 g |
| Water to make | 1 liter |
| (The pH value of the developer was adjusted to 11.5 with potassium hydroxide.) | |

Results are given in the following Table 1, where each term means as follows:

The result of "after forced deterioration" designates the photographic characteristics of each film, after the film was kept at 50° C. in a relative humidity of 75% for 3 days.

The "sensitivity" is represented by a relative value based on a reciprocal number of the exposure amount sufficient to give a density of 1.5, and the sensitivity of the film sample No. 1 (a fresh one immediately after being coated) was indexed to be 100.

The occurrence of "black spots" was evaluated by observing the non-exposed part of the film with a microscope, and this was classified by five grades "1" through "5", where "5" is the best and "1" is the worst. The grades of "4" and higher mean practical qualities; the grade of "3" means a coarse quality and is barely practical; and the grades of "2" and lower mean impractical qualities.

TABLE 1

| Sample No. | Emulsion | a/b* | Immediately after coated (fresh film) Sensitivity | Gamma | After forced deterioration Sensitivity | Gamma | Black spots | Remarks |
|---|---|---|---|---|---|---|---|---|
| 1 | A | 1 | 100 | 9 | 56 | 5 | 4 | Convention |
| 2 | B | 1 | 224 | 10.5 | 141 | 6.5 | 4 | Comparison |
| 3 | C | 3 | 200 | 12 | 162 | 10 | 4 | Present invention |
| 4 | D | 3 | 251 | 14 | 204 | 12 | 3~4 | " |
| 5 | E | 1 | 89 | 8.5 | 50 | 4.5 | 4 | Convention |
| 6 | F | 1 | 200 | 10.5 | 132 | 7.5 | 4 | Comparison |
| 7 | G | 5 | 182 | 11.5 | 145 | 9.5 | 4 | Present invention |
| 8 | H | 10 | 162 | 12.5 | 129 | 10.5 | 4 | " |
| 9 | I | 1 | 245 | 13 | 195 | 8 | 1 | Comparison |
| 10 | J | 1 | 178 | 12 | 141 | 5 | 2 | " |

*a/b means the ratio of (the silver iodide content in the surface part of grains)/(the average silver iodide content thereof), in the use silver halide grains.

The results given in the Table 1 show that the sensitivity and the gamma value of the sample Nos. 1 and 5 using a conventional emulsion were lowered after these were preserved at a high temperature and in a high humidity and that these films have a problem with the preservation stability thereof. On the other hand, sample Nos. 2 and 6, each having a silver halide emulsion prepared in the presence of an iridium salt, had a sensitivity and gamma value which was somewhat improved; the preservation stability thereof was still bad. With respect to sample Nos. 9 and 10, the former being characterized by the gold-sulfur sensitization and the latter being characterized by the use of silver halide grains having a larger average grain size, the sensitivity and the gamma value of the film were be improved; however, a noticeable occurrence of black spots is inevitable in both films due to the use of said conventional sensitization means.

In contrast, sample Nos. 3 and 4, and 7 and 8 of the present invention, which are characterized by the use of an emulsion containing silver haloiodide grains prepared in the presence of an iridium salt and having a larger silver iodide content in the surface part of grains than the average silver iodide content thereof, are noted to have both high sensitivity and high gamma value, and in addition, the photographic characteristics thereof hardly deteriorated when these were preserved at a high temperature and in a high humidity, and further, the occurrence of black spots in less.

EXAMPLE 2

A sensitizing dye (the above-described Compound No. 13) was added to each emulsion of the sample Nos. 1, 2, 3, 4 and 9 used in Example 1, in an amount of $4.3\times10^{-4}$ mole per one mole of silver, before being coated, and said emulsion was coated analogously to Example 1, to obtain sample Nos. 11, 12, 13, 14 and 15, respectively.

Preparation of Emulsion (K)

Potassiun iodide was added to the above obtained Emulsion (B) of Example 1, after being chemically sensitized, to convert the surface of the grains in the emulsion, whereby a silver iodobromide emulsion having a ratio (the average silver iodide content/the silver iodide content in the surface part of the grain, of 1/1.5 was obtained. This was called Emulsion (K).

In the same manner as in the preparation of the above samples, with the exception that the Emulsion (K) was used, sample No. 16 was prepared.

These sample Nos. 11 through 16 were exposed and developed analogously to Example 1, and the results are given in the following Table 2.

TABLE 2

| Sample | | | Immediately after Coated (fresh film) | | After forced deterioration | | Black |
|---|---|---|---|---|---|---|---|
| (No.) | Emulsion | a/b* | Sensitivity | Gamma | Sensitivity | Gamma | spots |
| 11 | A | 1 | 100 | 13 | 45 | 7 | 4 |
| 12 | B | 1 | 263 | 15 | 132 | 8 | 4 |
| 13 | C | 3 | 234 | 16 | 214 | 14 | 4 |
| 14 | D | 3 | 288 | 17 | 263 | 15 | 4 |
| 15 | I | 1 | 275 | 17 | 195 | 13.5 | 1 |
| 16 | K | 1.5 | 257 | 17 | 209 | 14 | 4 |

*See definition in Table 1.

Table 2 shows that sample Nos. 13, 14 and 16 of the present invention have higher sensitivity and higher contrast than the other samples, and in addition, the deterioration after being preserved and the occurrence of black spots are extremely slight. Furthermore, it is apparent that the sensitivity and the gamma value of the present sample Nos. 13, 14 and 16 are improved due to the incorporation of the sensitizing dye.

While the invention has been described in detail and with reference to specific embodiments thereof, it will be apparent to one skilled in the art that various changes and modifications can be made therein without departing from the spirit and scope thereof.

What is claimed is:

1. A negative silver halide photographic light-sensitive material having a silver halide emulsion layer, which layer comprises monodispersed cubic or tetradecahedral silver haloiodide grains prepared in the presence of an iridium salt in an amount of $1\times10^{-8}$ to $1\times10^{-5}$ mole per one mole of silver, wherein the silver iodide content in the surface part of said grain is larger than the average silver iodide content in said grain, and additionally containing in said emulsion layer or in some other hydrophilic colloid layer, a compound of formula (I):

$$R_1\text{—NHNH—CHO} \qquad (I)$$

wherein $R_1$ represents an aliphatic group or an aromatic group, wherein the silver iodide content in the surface part of the silver halide grains is larger than the average silver iodide content thereof by 50% or more.

2. The negative silver halide photographic light-sensitive material as claimed in claim 1, wherein said iridium salt is selected from water-soluble iridium salts and iridium complexes.

3. The negative silver halide photographic light-sensitive material as claimed in claim 2, wherein said iridium salt is iridium trichloride, iridium tetra-chloride, potassium hexachloro-iridate(III), potassium hexachloro-iridate(IV), or ammonium hexachloro-iridate(III).

4. A method for formation of negative images of ultra-high contrast, characterized in that a negative silver halide photographic light-sensitive material having a silver halide emulsion layer, which layer comprises monodispersed cubic or tetradecahedral silver haloiodide grains prepared in the presence of an iridium salt in an amount of $1\times10^{-8}$ to $1\times10^{-5}$ mole per one mole of silver, wherein the silver iodide content in the surface part of said grain is larger than the average silver iodide content in said grain, and additionally containing in said emulsion layer or in some other hydrophilic colloid layer, a compound of a formula (I):

$$R_1\text{—NHNH—CHO} \qquad (I)$$

wherein $R_1$ represents an aliphatic group or an aromatic group, is exposed image-wise and then treated with a developer containing 0.15 mole/l or more sulfite ion and having a pH value of 9.5–12.3, wherein the silver iodide content in the surface part of the silver halide grains is larger than the average silver iodide content thereof by 50% or more.

5. The negative silver halide photographic light-sensitive material as claimed in claim 1, wherein said silver haloiodide grains have an average grain size of 0.7μ or less.

6. The negative silver halide photographic light-sensitive material as claimed in claim 1, wherein said silver haloiodide grains have an average grain size of 0.5μ or less.

7. A method as claimed in claim 4, wherein said silver haloiodide grains have an average grain size of 0.7μ or less.

8. A method as claimed in claim 4, wherein said silver haloiodide grains have an average grain size of 0.5μ or less.

* * * * *